US008382398B2

(12) United States Patent
Stauffacher et al.

(10) Patent No.: US 8,382,398 B2
(45) Date of Patent: Feb. 26, 2013

(54) RIPARIAN FLOOD WALL STRUCTURE

(75) Inventors: Deborah A. Stauffacher, Beloit, WI (US); Craig A. Verden, Beloit, WI (US)

(73) Assignee: Deborah A. Stauffacher, Thorp, WI (US)

( * ) Notice: Subject to any disclaimer, the term of this patent is extended or adjusted under 35 U.S.C. 154(b) by 1243 days.

(21) Appl. No.: 11/324,861

(22) Filed: Jan. 4, 2006

(65) Prior Publication Data

US 2007/0154265 A1 Jul. 5, 2007

(51) Int. Cl.
*E02B 7/14* (2006.01)

(52) U.S. Cl. ..... 405/111; 405/284

(58) Field of Classification Search ..... 405/107, 405/110, 111, 284
See application file for complete search history.

(56) References Cited

U.S. PATENT DOCUMENTS

| | | | | | |
|---|---|---|---|---|---|
| 250,635 | A | | 12/1881 | McLean | 52/306 |
| 422,901 | A | | 3/1890 | Arnett | 405/114 |
| 3,305,982 | A | | 2/1967 | Steele | 52/90.1 |
| 3,618,279 | A | * | 11/1971 | Sease | 52/223.7 |
| 4,436,447 | A | | 3/1984 | Crowe | 405/16 |
| 4,516,364 | A | * | 5/1985 | Heider | 52/98 |
| 4,787,189 | A | * | 11/1988 | Haug et al. | 52/415 |
| 5,230,195 | A | * | 7/1993 | Sease | 52/592.6 |
| 5,454,195 | A | | 10/1995 | Hallsten | 52/169.1 |
| 5,471,808 | A | * | 12/1995 | De Pieri et al. | 52/603 |
| D368,939 | S | * | 4/1996 | Frederiksen | D21/500 |
| 5,511,902 | A | | 4/1996 | Center | 405/16 |
| 5,688,079 | A | | 11/1997 | Bolduc et al. | 405/286 |
| 5,865,564 | A | | 2/1999 | Miller et al. | 405/115 |
| 5,934,037 | A | * | 8/1999 | Bundra | 52/603 |
| 5,984,576 | A | | 11/1999 | Zetzsch | 405/110 |
| 6,050,044 | A | | 4/2000 | McIntosh | 52/591.1 |
| 6,164,870 | A | | 12/2000 | Baruh | 405/114 |
| D456,463 | S | * | 4/2002 | Sorensen | D21/500 |
| D457,971 | S | * | 5/2002 | Schrader et al. | D25/113 |
| 6,394,705 | B1 | | 5/2002 | Lefebvre | 405/262 |
| 6,416,253 | B1 | * | 7/2002 | Wimp et al. | 405/172 |
| D470,196 | S | * | 2/2003 | Sorensen | D21/499 |
| 6,571,525 | B2 | * | 6/2003 | Coleman | 52/592.5 |
| 2005/0163576 | A1 | * | 7/2005 | Boys | 405/284 |

OTHER PUBLICATIONS

Web page, "How the Invisible Flood Control Wall works", from www. floodcontrolam. corn, dated Nov. 9, 2005, 1 page.
Web pages, "Aqua-Barriers—Water-Inflated Dams", from www. aquabarrier. com, dated Oct. 26, 2001, 4 pages.

* cited by examiner

*Primary Examiner* — Tara M Pinnock
(74) *Attorney, Agent, or Firm* — Ryan Kromholz & Manion, S.C.

(57) ABSTRACT

A modular flood wall assembly having a relatively flat base member having a plurality of ribs extending therefrom. The assembly further comprises a plurality of interconnectable blocks, with each block having a top surface with at least one hollow protuberance, at least one side wall, a hollow interior, and a bottom surface having at least one hollow cavity. The cavities on the bottom surface of the blocks are matable with the ribs on the base member. The protuberances on the top surface of the blocks are matable with the receptacles on the bottom surface of a corresponding block.

9 Claims, 7 Drawing Sheets

RIPARIAN FLOOD WALL STRUCTURE

BACKGROUND OF THE INVENTION

The present invention relates to mobile support structures and, more specifically, to mobile support structures to be used as break walls and flood walls.

During floods, storms and bad weather, it may be necessary to quickly construct and erect levees, dams or the like along river banks and other water sources to protect against flood damage. Similarly, during particularly rainy seasons or heavy spring thaws it may be necessary to construct a temporary flood wall or dam until the water levels subside. Conventionally, this has been done by stacking sand bags upon one another to form a wall or barrier. However, this can be an arduous and difficult process. Thus, artificial walls have been designed that are easier to assemble and construct.

Some contemplated structures have included inflatable walls. While these bladder-type walls do form a barrier to keep water away, the size of the formed dam cannot be easily adapted to accommodate different sized areas. Thus, if the area that needs to be dammed is larger than expected, it is not easy to stack such structures upon one another, thereby limiting their utility in emergencies. Similarly, such structures are generally space intensive, which is inhibitive for use by individuals.

Other structures have been designed that comprise interconnectable blocks that can be stacked to form a wall structure. As an example, Zetzsch, U.S. Pat. No. 5,984,576, shows a mobile barrier that has blocks that can be connected using S-shaped block ends that fit together. The blocks form an airtight structure that stacks vertically upward. However, the blocks are not interconnectable horizontally, or side to side, which limits the efficiency of using the blocks for areas that do not correlate directly to the size of the blocks. If the length of the wall needs to be extended, the wall will not easily form a complete sealing structure.

Lefebvre, U.S. Pat. No. 6,394,705, discusses a modular flood wall that has interlocking blocks having hollow interiors that can be filled with material to give the wall added support. Thus, the wall is light-weight for transportation and assembly purposes, but will form a solid, sturdy structure when it becomes filled. Still, the modular blocks are not designed so that they can be stacked in an upwardly interlocking fashion, which limits the height of the wall. If it was necessary to stack the blocks upon one another, they would not necessarily form a tight seal, and it may be difficult to fill lower level blocks with material.

Arnett, U.S. Pat. No. 422,901, discusses the use of blocks that may be stacked upon one another to form a dam. However, the discussed blocks are not lightweight, which does not make the wall as useful as necessary in emergency situations. The system is not designed as a lightweight portable structure that may be easily erected in emergency situations.

Thus, it would be advantageous to devise a portable flood wall that provides adequate protection against flooding, while being easy to erect and transport. The wall should also evenly disperse the pressure that comes from the retained water pushing against the wall. A lightweight, yet durable wall that can be used to fix flood leaks of varying sizes is thus contemplated.

SUMMARY OF THE INVENTION

The present invention comprises interlocking, stacking blocks having a hollow interior that can be easily filled with water so that the wall will have added strength and stability when holding back flood waters. Ideally, this modular flood wall structure will be used in place of sandbags that are commonly used to prevent flooding in those certain areas.

The invention comprises a base and a series of variously shaped modular building elements or blocks that fit together in much the same way as Legos™ blocks. One or more protuberances are formed in the upper surfaces of each block and one or more mating receptacles are formed on the lower surfaces. Alternatively, this arrangement could be spatially reversed. In order to act as a retaining wall, these blocks are actually hollow vessels that are filled with water in order to lend strength and stability to the wall structure itself. Ideally, the walls will themselves be watertight and, to that end, each of the blocks is provided a seal structure on its adjoining surfaces to prevent the passage of water therebetween. One such structure includes a series of interlocking ribs formed in the abutting surfaces of the blocks, though other types of structures may be envisioned. In addition, the present invention may be used alone or in conjunction with sandbags and/or watertight membranes to form a wall that will hold back floodwaters.

Each of the blocks comprises a hollow vessel having a generally cubic/rectangular shape in a first embodiment. The upper surface of each of the blocks is provided with a series of projections or protuberances that are constructed and arranged to be received within a series of complementary receptacles or receptacles formed into the bottom surfaces of the blocks. The base of the flood wall structure is essentially an elongate sheet having raised ribs formed on its edges. The elongate base is typically staked to the earth in a desired location and the blocks are placed thereon between the ridges on the base's edges. It is preferable to fill each course of blocks with water prior to placing a subsequent course of blocks thereover. In order to support the weight of the blocks and water, it is preferred to emplace various support structures within the blocks themselves. The support structures typically comprise a series of posts or columns disposed around the exterior edges of the interior walls of the blocks with at least one center support also being placed therein. Alternatively, the supporting structures or columns may be formed as a rigid structure exterior to the blocks themselves.

Alternatively, the assembled wall may also include blocks that are not composed of cubical or parallelepiped shaped blocks. Such an arrangement of blocks may be advantageous for constructing a wall on a sloped surface.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
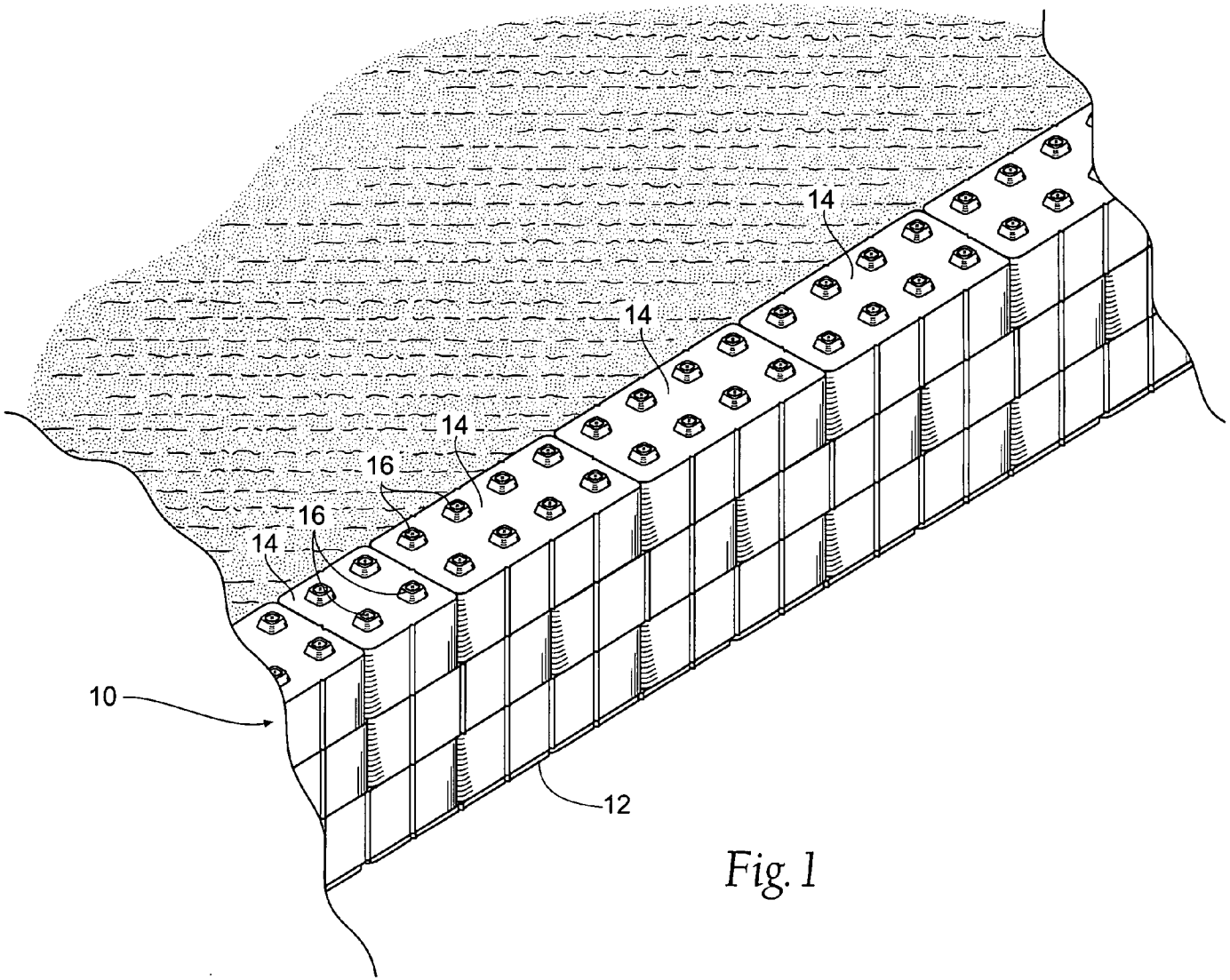
FIG. 1 is a cut-away perspective view of a modular flood wall assembly according to the present invention.

FIG. 1 shows a perspective view of a modular wall assembly 10. The assembly generally comprises a base member 12 and a plurality of stackable blocks 14. Each of the blocks 14 has a plurality of protuberances 16. The protuberances 16 are arranged so that the blocks 14 can be easily mated with one another in an interlocking fashion to form a solid wall. As shown, the blocks 14 can be of differing sizes from one another. The base member 12 preferably is secured to the ground or other external force with stakes, rods, or other possible securing devices (not shown).

Figure 2:
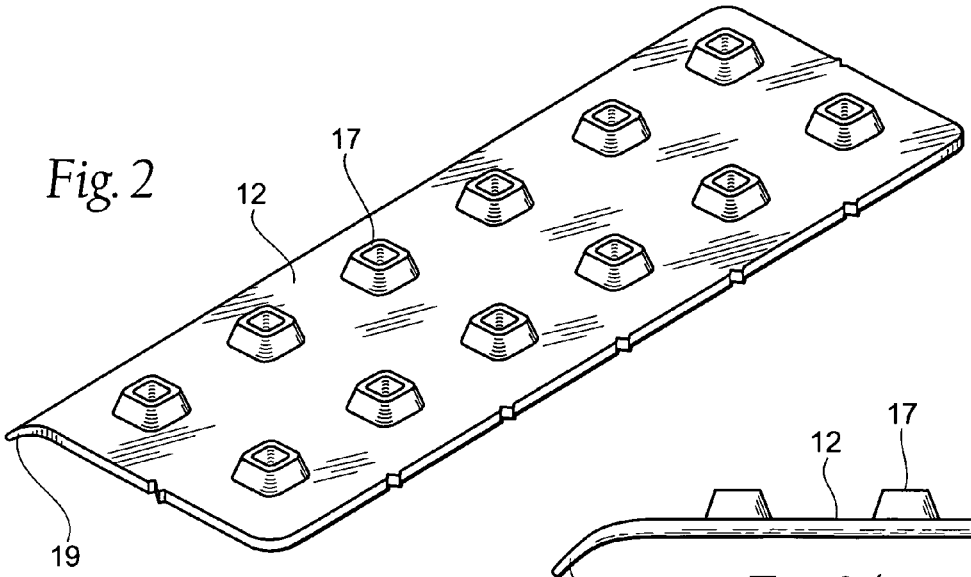
FIG. 2 is a perspective view of a support base according to the present invention.
Figure 2A:
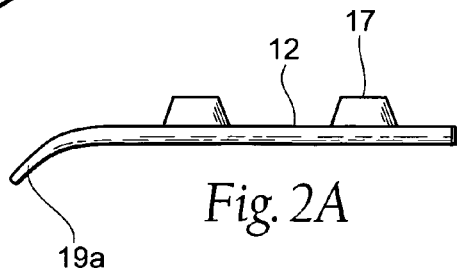
FIG. 2A is an elevated side view of the support base of FIG. 2.
Figure 2B:
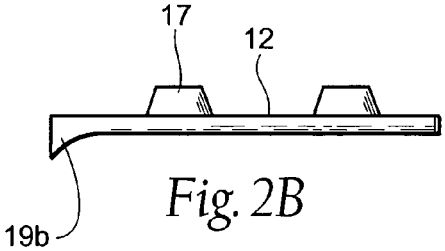
FIG. 2B is an elevated side view of an alternate embodiment of a support base according to the present invention.

As shown in FIGS. 2, 2A, and 2B, the base member 12 also has a plurality of ribs 17, designed similarly to the protuberances 16 located on the blocks 14. The ribs 17 allow the blocks 14 to be secured upon the base member 12 to form the eventual wall assembly 10 (see FIG. 8). The base member 12 is preferably an elongated sheet of flexible material, possibly a rubber, vinyl, or plastic material, but any other suitable materials, such as a lightweight tin or aluminum material, may be used. As previously stated, the base member 12 will be secured to the ground using stakes or other conventional securing devices. An extension 19 may be located on the base member 12, preferably integral as one piece with the base, to prevent flood water from seeping under the base member 12. The extension 19 will be angled downward, which will assist in preventing the water from eroding away the dirt underneath the base member 12. Various designs can be seen as extension 19*a* (FIG. 2A), which has a curved or hook shape, and an extension 19*b* (FIG. 2B), having a shape designed for digging into the ground surface. Preferably, the base member 12 is long enough that it will accommodate several blocks 14. As a way of example, the base member 12 may consist of a long length of pliable material that could then be sized accordingly, by folding or cutting, to the required size of the flood wall.

Figure 3:
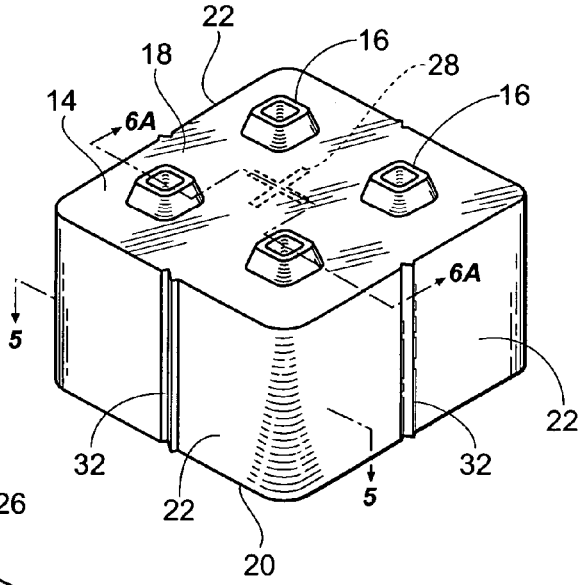
FIG. 3 is a perspective view of a building block according to the present invention.

FIG. 3 shows a perspective view of an individual block 14. The block 14 has a top surface 18 and a bottom surface 20. It should be understood that the use of a top surface and a bottom surface should not limit the blocks 14 to any specific spatial arrangement, but rather to distinguish one side from the other. The protuberances 16 extend outwardly from the top surface 18 of the block 14. As shown in FIG. 3, the block 14 is shown having a generally cubical arrangement with four identical sides 22. However, the blocks 14 could be rectangular or another geometrical shape, provided that the blocks could be interlocked and stacked as described herein. As a comparison, FIG. 1 shows blocks 14 having a more elongated rectangular shape compared to the cubical shape shown in FIG. 3. The symmetrical arrangement of the block 14 allows for easy orientation when erecting the wall assembly 10. The protuberances 16 are hollow, thereby allowing access into the interior 24 of the block 14 (see FIGS. 5, 6A, 6B and 8). This allows the block 14 to be filled with water when constructing the wall assembly 10, which gives the wall additional strength and support when buttressing flood waters (see FIG. 7).

Figure 4:
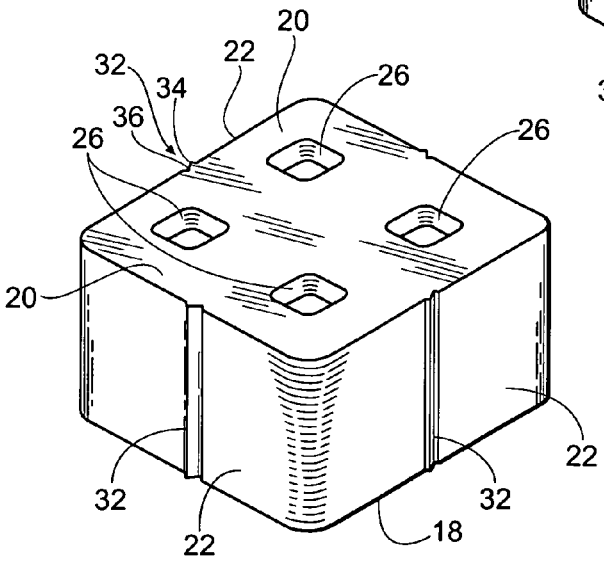
FIG. 4 is a bottom perspective view of the block of FIG. 3.

FIG. 4 is a bottom perspective view of the block 14. The bottom surface 20 also has a plurality of receptacles 26 located thereon. The receptacles 26 extend inwardly into the interior 24 of the block 14, which provides an area for the protuberances 16 on the top surface 18 to mate with the receptacles 26 on the bottom surface 20 (see FIG. 8). The receptacles 26 can generally be described as inverted protuberances 16, which allows for a secure mating arrangement. The receptacles 26 and protuberances can be of any shape or size, provided they form a sufficient mating arrangement. As with the protuberances 16, the receptacles 26 are also hollow, which allows access into the interior 24 of the block 14.

Figure 11:
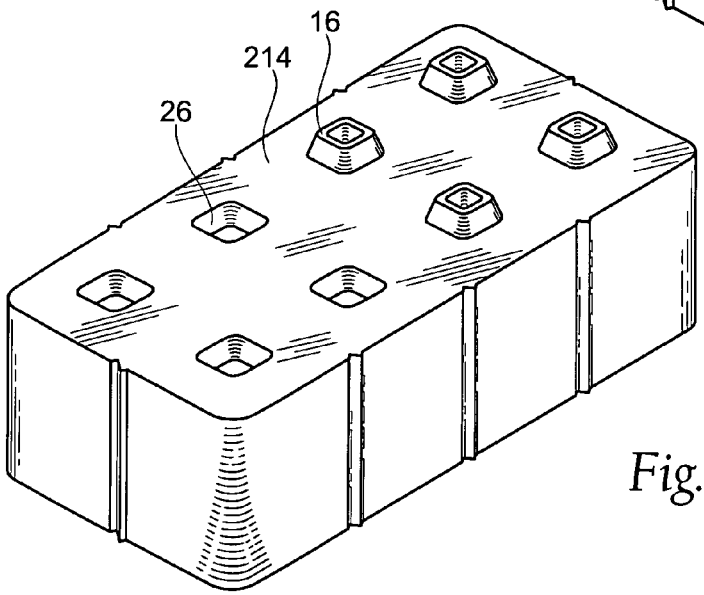
FIG. 11 is a perspective view of another embodiment of the present invention.

FIGS. 3 and 4 can be viewed as showing an inverted embodiment of the block 14, as well. That is, FIG. 3 could be showing the bottom surface of a block, where the protuberances 16 are located on the bottom surface, and FIG. 4 would then be depicting the top surface of a block, where the receptacles 26 are located on the top side. Alternatively, the top surface 18 and the bottom surface 20 could have protuberances and receptacles located on each respective side. An example of such an embodiment is shown in FIG. 11. The block 214 has both protuberances 16 and receptacles 26 on each side of the block 214. Provided that the arrangement of the protuberances 16 and receptacles 26 on the top and bottom surfaces will allow an individual block to mate with a corresponding block, the arrangement would fall within the scope of the present invention.

Figure 5:
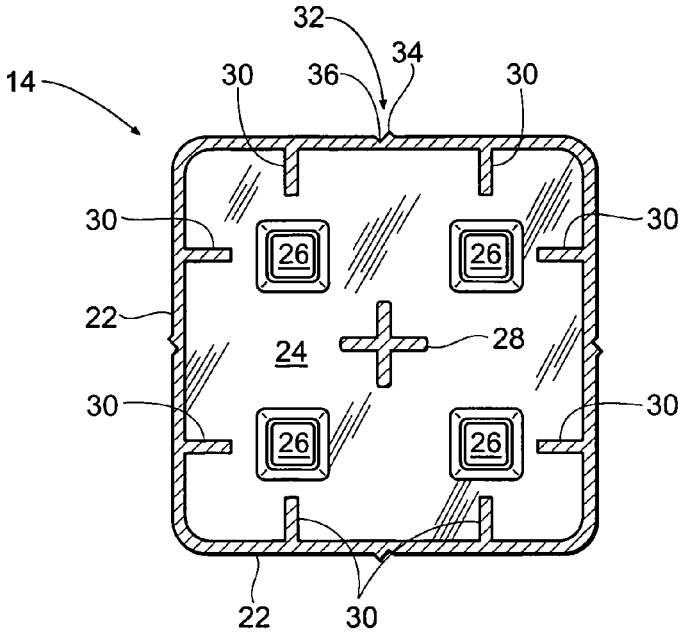
FIG. 5 is a cross-sectional view of the building block taken along line 5-5 of FIG. 3.

FIG. 5 provides a cross-sectional view of the block 14. The block 14 has a center support 28 that extends from the bottom surface 20 to the top surface 18. The block also has a plurality of side supports 30 that are preferably symmetrically arranged for further stability of the block 14. The supports 28 and 30 add stability and rigidity to the blocks 14 without significantly increasing the mass of the empty blocks 14 and without preventing the flow of water throughout the interior 24 of the blocks 14 when filling the blocks 14 with water.

Figure 6A:
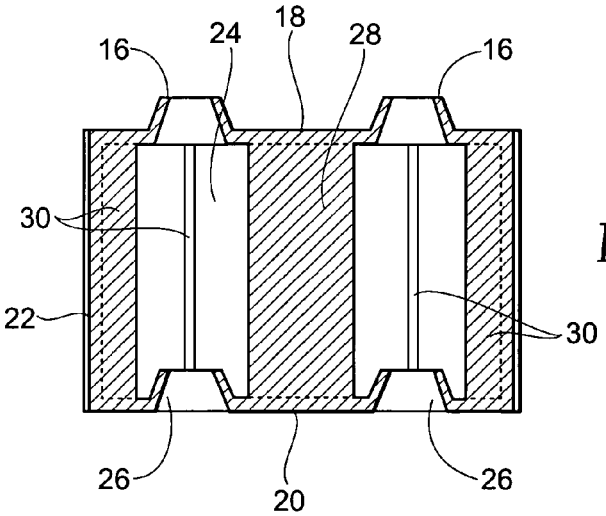
FIG. 6A is a cross-sectional view of the building block taken along line 6A-6A of FIG. 3 showing the internal support structures of the block.
Figure 6B:
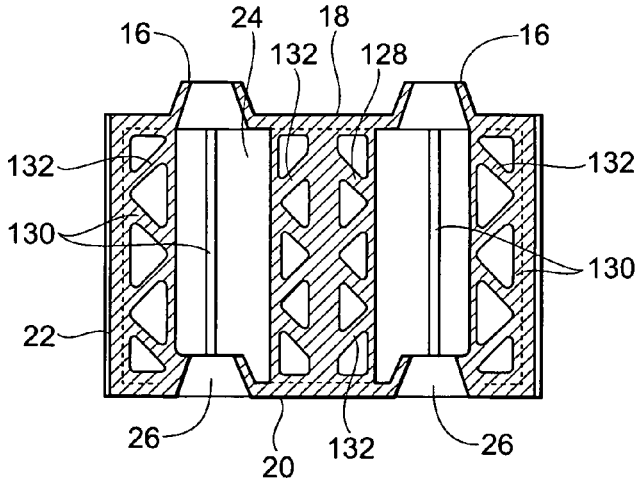
FIG. 6B is a cross-sectional view of a building block showing an alternate internal support structure to that shown in FIG. 6A.

FIG. 6A shows a cross-sectional view of the block 14 taken along line 6A-6A of the block 14 of FIG. 3. As previously stated, the center support 28 extends from the bottom surface 20 to the top surface 18. The side supports 30 reinforce the strength in the corner of the blocks 14, without adding significant weight to the blocks 14. It is understood that depending on the size of the blocks 14, there may be more or fewer supports located within the interior 24 of the block 14. As can also be seen in FIG. 6A (and FIG. 6B), the hollow design of the protuberances 16 and the receptacles 26 will allow water to pass through the interior to a block located below the block 14. This will be more evident with respect to FIGS. 7 and 8. FIG. 6B shows an alternate arrangement for a center support 128 and side supports 130. The supports 128 and 130 are designed of angled braces 132, which provide a structural support for the block 14, but will be lighter. This may be advantageous in moving and arranging larger sized blocks.

Referring again to FIGS. 3-5, the sides 22 of the block 14 further comprise coupling areas 32. The coupling areas 32 allows side by side blocks to be connected to one another, thereby strengthening the wall and further preventing leaking in between the individual blocks 14. The coupling areas 32 can be of any size or shape that will allow side by side blocks 14 to be joined together. Each side 22 preferably has a coupling area 32. As shown, the coupling areas 32 preferably have a simple, symmetrical shape, with both a male area 34 and a female area 36 within each coupling area 32. The coupling areas 32 are designed with sufficient depth and interconnectability to prevent water from seeping between two blocks 14. Having a coupling area on each side of the block 14 provides for an overall easier construction of the assembly 10, since the blocks 14 can be connected or locked together with an adjacent block 14 from any side 22. It is also possible to design the blocks 14 with only one set of opposing sides having coupling areas 32. Preferably, the coupling areas 32 are formed of a material that is flexible enough so that the blocks will seal easily when filled with water.

Figure 7:
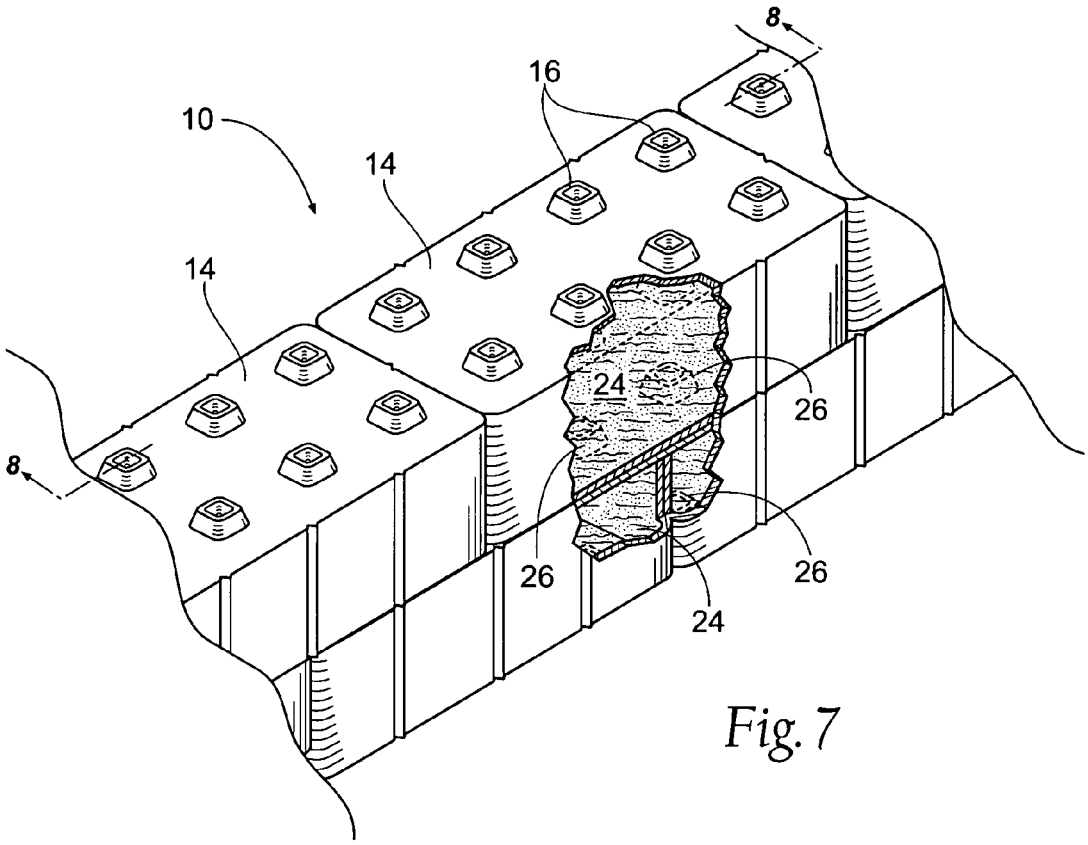
FIG. 7 is a partially cut-away view of the modular flood wall assembly.

FIG. 7 shows a partially cut-away view of the wall assembly 10. The interior 24 of the blocks 14 are shown containing water, which gives the wall assembly 10 added strength and stability. The blocks 14 are also stacked with each tier of blocks 14 alternating in alignment so that the blocks 14 in one tier overlap the blocks 14 in the tier above and below that tier. This provides further stability for the wall assembly 10. Also, because of the hollow protuberances 16 and receptacles 26, the staggered arrangement allows all of the blocks 14 in a tier to be evenly filled with water in a simple fashion. Essentially, the arrangement allows the individual interiors 24 of each of the blocks 14 to act as a single interior, which makes filling with water a straightforward process and, also, evenly distributes weight within the wall. Because the water will evenly flow through the blocks 14, weight will be evenly dispersed throughout the wall. Prior art modular structures that do have hollow interiors may not be filled with water quickly and efficiently as can be accomplished in the present invention.

Figure 8:
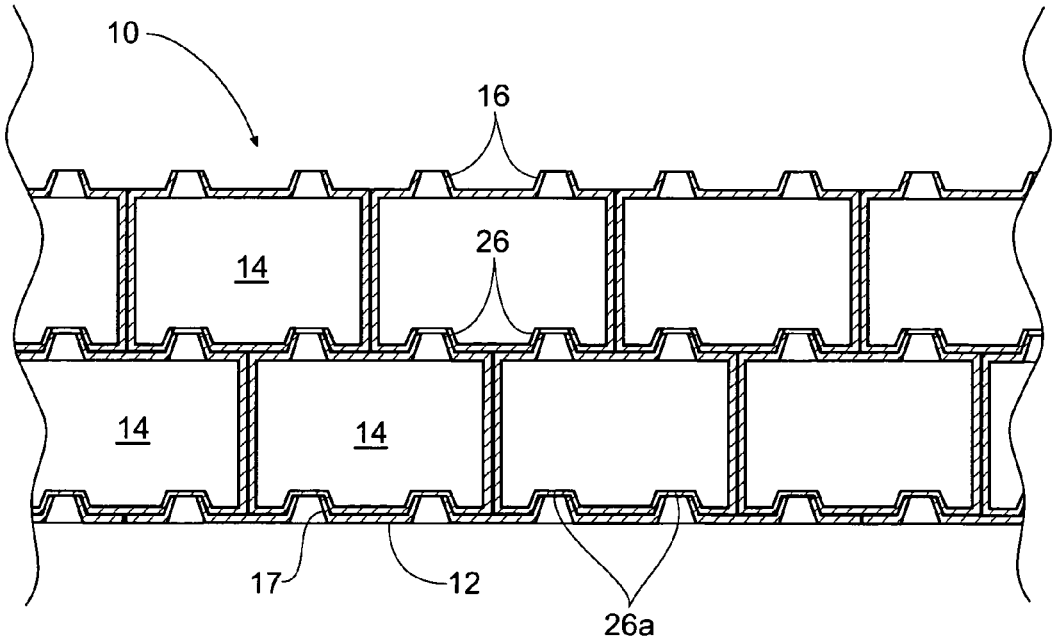
FIG. 8 is a cross-sectional view of the flood wall assembly taken along line 8-8 of FIG. 7.

FIG. 8 shows a cross-sectional cut-away view of the assembly of FIG. 7. Because the receptacles 26 and the protuberances 16 are open, water may flow between the blocks 14, which allows for each tier of the blocks 14 to be evenly filled. The blocks 14 are depicted as being symmetrical, with the protuberances 16 and the cavities 26 being vertically aligned with one another on each block 14, which also allows for vertical alignment of the protuberances and cavities 26 on corresponding blocks 14. The open water way consisting of the interiors 24 of the blocks 14 provides a much easier and more efficient arrangement for filling the wall assembly with water or other fluid than prior art arrangements. While it is understood that all of the protuberances 16 and receptacles 26 are preferably hollow, it is understood that in some embodiments some of the protuberances and/or receptacles may be sealed. The bottom protuberances 26*a* are preferably sealed so that water will not flow between the base member 12 and the bottom row of blocks 14.

Figure 9:
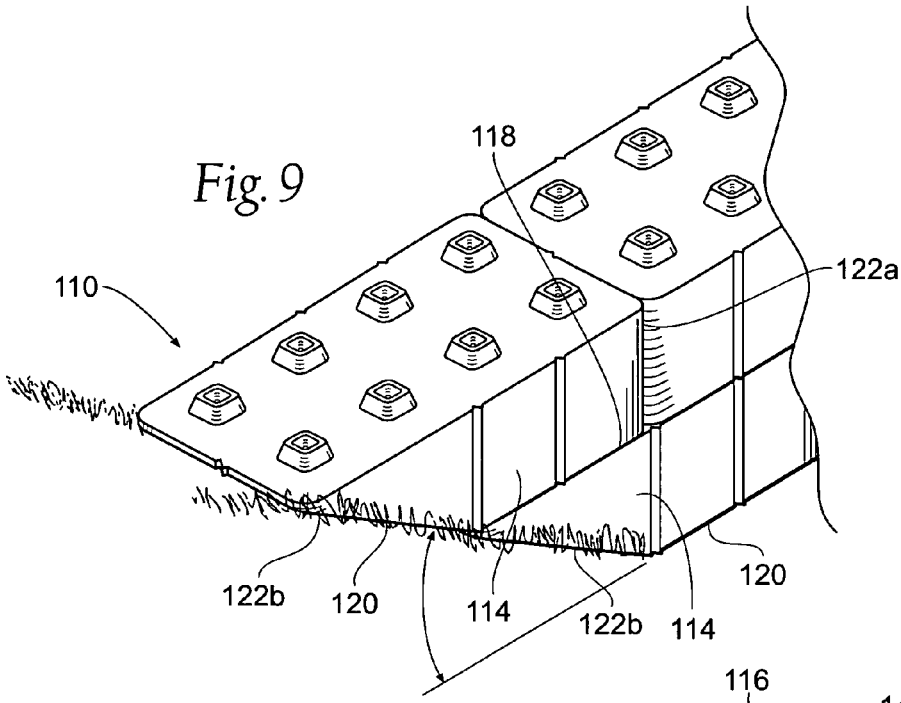
FIG. 9 is a perspective view of an alternate embodiment of a building block and flood wall assembly used in the present invention.

FIG. 9 shows another embodiment 110 of the present invention. The wall assembly 110 is similar to the assembly 10, except that blocks 114 do not have a parallelepiped shape or cubical shape. A side wall 122*a* is not parallel to a side wall 122*b*. Because the ground or other external surface that the wall 110 is situated between may be sloped, a wall using only square blocks 14 would not allow for even stacking of successive rows. Preferably, a top surface 118 is parallel to a bottom surface 120. The blocks 114 allow a wall to be erected quickly on a variety of surface contours while still providing for a vertical wall assembly 110. The shape of the blocks 114 could be designed for any shape necessary for a respective area of ground. The angle θ formed between the side wall 122*b* and the bottom surface 120 may be any desired angle. The remaining area of the assembly 10 would use blocks 14, as previously discussed.

Figure 10:
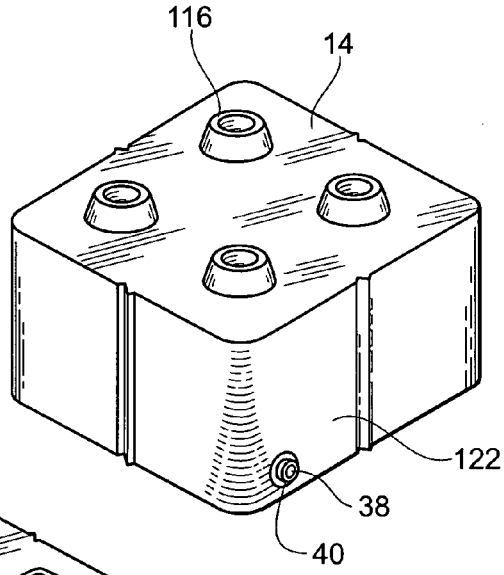
FIG. 10 provides a perspective view of a block according to the present invention.

FIG. 10 shows the block 14 having an inlet 38 containing a plug 40. The inlet 38 allows for an alternate place to fill the blocks 14 with water. The inlet 38 may be located anywhere on the side 22 and may be of any design, such as a spigot that could be coupled to a hose. The inlet 38 would make draining of the blocks 14 quicker once the wall assembly 10 is no longer needed. Also, the protuberances 116 have a circular shape, compared to the square protuberances 16 previously depicted. The protuberances 116 demonstrate that any shaped protuberance (and cavity) will fall within the scope of the present invention.

Figure 12:
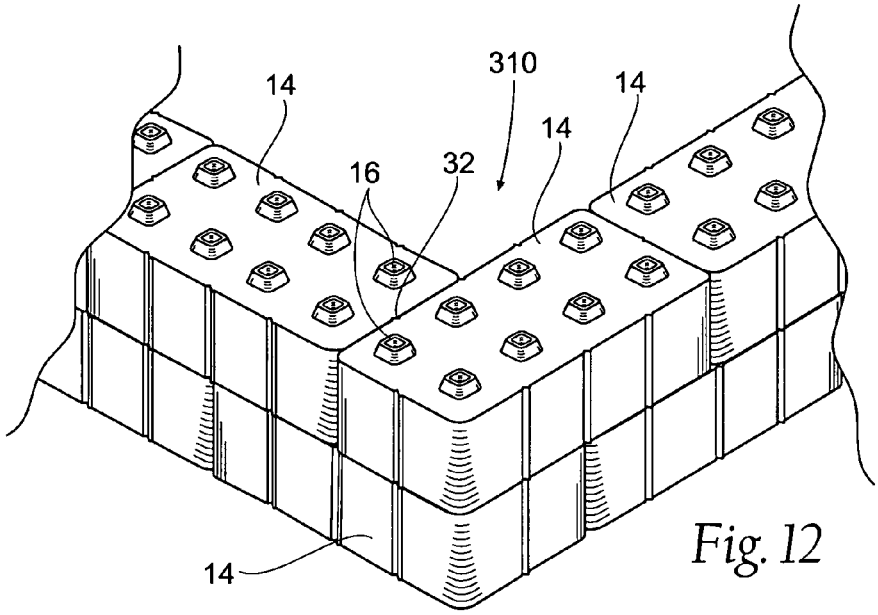
FIG. 12 is a perspective view of an alternate arrangement of the modular flood wall assembly of the present invention.

FIG. 12 shows a perspective view of an alternate wall assembly 310. The assembly 310 is essential as the assembly 10 previously discussed, except the assembly 310 is shown forming a corner. Because of the symmetrical arrangement and design of the protuberances 16 and the coupling areas 32 on the blocks 14, a corner is easily formed, while still providing sealing arrangement. The design of the blocks 14 would allow for a wall arrangement having a T-shaped or L-shaped arrangement.

Figure 13:
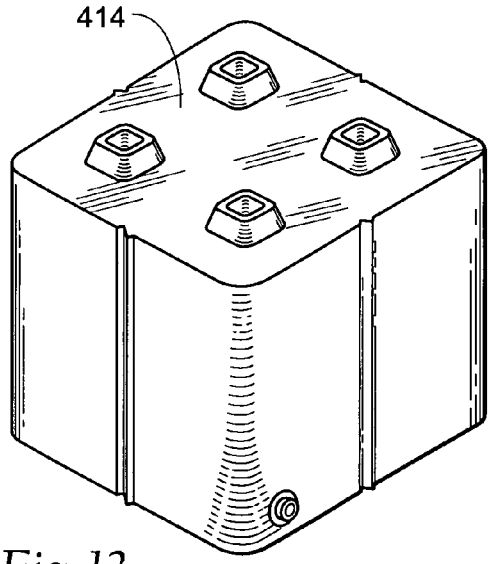
FIG. 13 is a perspective view of an alternate sized building block according to the present invention.

FIG. 13 shows an alternate block 414. The block 414 demonstrates that the blocks can be designed of any size depending on specific needs. Because the blocks are of lightweight material, the blocks may be designed of larger sizes than prior art blocks. For example, the block 414 may be easily constructed as 4'×4'×4' blocks, and still be easy to move and construct. While the size of the blocks may be designed of any dimensions, symmetrical blocks as discussed would be most advantageous for manufacturing and wall assembly purposes.

Figure 14:
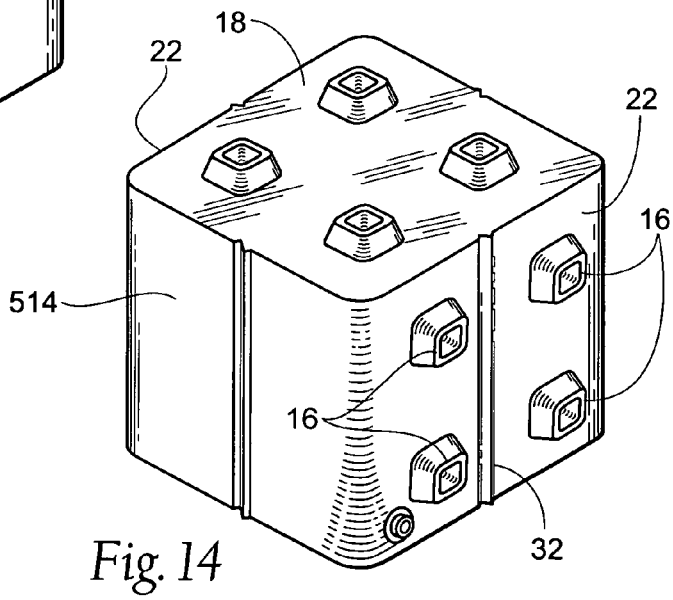
FIG. 14 is a perspective view of an alternate embodiment of a building block according to the present invention.

FIG. 14 shows a yet further embodiment of a block 514. The block 514 is similar to the previous embodiments except that protuberances 16 are located on the side wall 22 as well as on the top surface 18. Receptacles 26 (not shown) would be located on the opposing side wall 22 to mate with the protuberances 16 in the same fashion as previously described with respect to the previous figures and blocks. The use of the protuberances 16 further allows water to flow through the blocks 514 so that water within the blocks 514 will be evenly distributed throughout the blocks 514, similarly to the description of the wall assembly 10 in FIGS. 7 and 8. The blocks 514 are shown with a coupling area 32. However, because the protuberances 16 and the receptacles 26 will further secure and seal the block 514 to a corresponding block 514, the coupling area 32 could be optional, and the protuberances 16 and the receptacles 26 would act as a coupling area. Also, the protuberances 16 could be placed in other places on the side walls 22, such as centrally located where the coupling area 32 is shown in FIG. 14. When the blocks 514 are used to construct a wall, it is preferable that the protuberances 16 located on the outermost blocks either be sealed, or the outermost side walls 22 could be designed without protuberances 16 (as in blocks 14), to prevent leaking.

Figure 15:
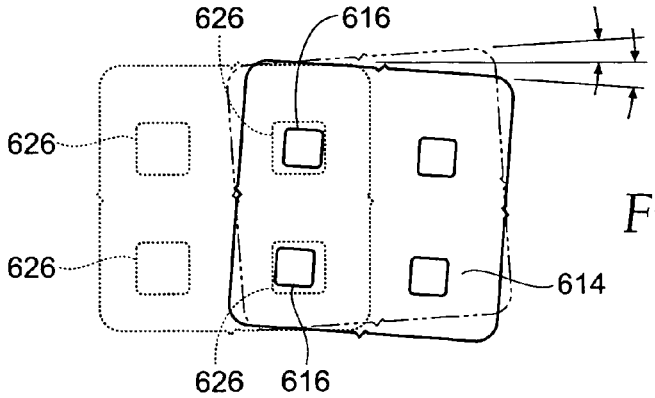
FIG. 15 is an overhead view of a further embodiment of a building block according to the present invention.
Figure 16:
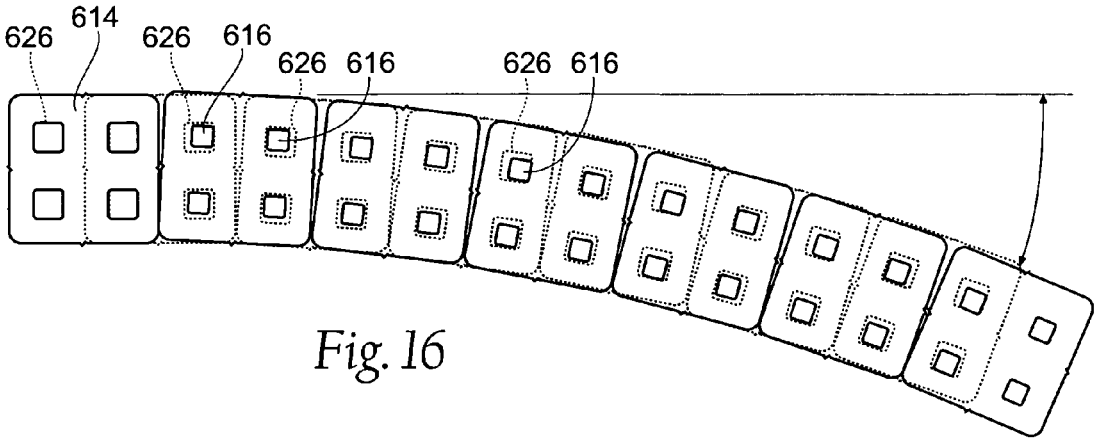
FIG. 16 is an overhead view of a flood wall assembly using building blocks shown in FIG. 15.

FIGS. 15 and 16 depict blocks 614 having a different protuberance 616 and receptacle 626 (shown in phantom) arrangement. Previously, the protuberances 16 and receptacles 26 (see FIG. 8) were of relatively the same size, so that they would have a tight fitting relationship. While the mating principles are similar to those previously discussed, the protuberances 616 are designed to be of a smaller diameter/cross-sectional area than the corresponding receptacles 626, so that an upper row of blocks 14 can be arced or turned, to adjust for the need of a curved wall. The difference in the area of the protuberances 616 and the receptacles can be varied as necessary. However, it is preferable that the differences in the areas of the protuberances 616 and the receptacles 626 are not too great, to still allow the wall to form an adequate retention structure.

Figure 17:
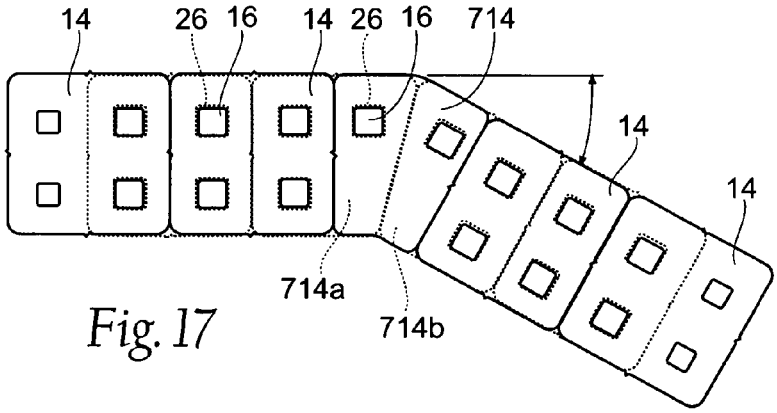
FIG. 17 is another alternate flood wall assembly according to the present invention.
Figure 18:
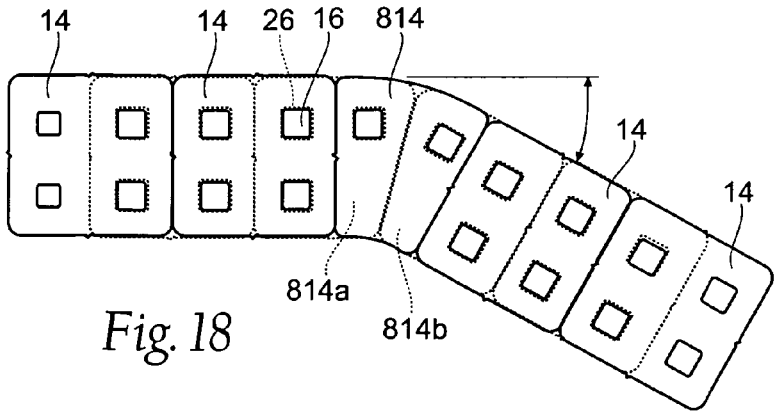
FIG. 18 is further flood wall assembly according to the present invention.

FIGS. 17 and 18 provide alternate designs that provide curved or arced walls. In FIG. 17 a corner block 714 allows the wall to be angled. In the row or tier of blocks below the corner block 714 are mating angled blocks 714*a* and 714*b* (shown in phantom) to allow the corner block 714 to fit upon the angled blocks 714*a* and 714*b*. The angle or angles of the blocks 714, 714*a*, and 714*b* can be of any desired angle. The remaining blocks can be of the structure as previously described in the preceding Figures. FIG. 18 provides a similar arrangement to that of FIG. 17 except a curved block 814 is used in place of the block 714. Likewise, curved angled mating blocks 814*a* and 814*b* (shown in phantom) are used in place of blocks 714*a* and 714*b*. Provided that a wall having an internal water pathway is formed as described, the angles and shapes of the blocks should not limit the scope of the present invention. The mating principles for the protuberances 16 and the receptacles 26, to allow flow of water through the interiors 24 of the blocks, are the same as previously discussed.

Preferably the blocks are filled with water after each layer of blocks is laid down for support purposes. However, because of the fact that all of the individual interiors 24 are preferably open to one another, it may also be possible to fill the blocks after the wall is completed. This flexibility further enhances the novelty of the present invention. As the wall is filled with water, the weight of the water will not only provide extra stability to the wall, but will also assist in the necessary sealing between adjacent blocks.

It is preferred that the blocks be fabricated from a plastic material as by injection molding or blow molding or other known molding procedures. Rotational molding may also be used for forming the blocks. Given the size of these blocks, and given the need to emplace support structures therein, one process of constructing the individual blocks is to form the block in two halves and thereafter weld the halves together with known plastic welding techniques.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A modular flood wall assembly comprising:

a plurality of interconnectable blocks, each of said blocks comprising:

a top surface having at least one hollow protuberance;

at least one side wall;

a hollow interior;

a sealable inlet located on at least one said side wall, said inlet connected to said hollow interior;

a bottom surface having at least one hollow receptacle;

said hollow interior being openly connected to said protuberance and said receptacle, said hollow interiors of said individual blocks forming a single hollow interior, said single hollow interior capable of allowing the free flow of water through the single hollow interior in both the horizontal and vertical direction;

said protuberances on said top surface of said blocks being matable with said receptacles on said bottom surface of a corresponding block;

whereby said outlet allows for the addition and removal of water into and out of the hollow interior of the modular, said outlet capable of sealably and selectively retaining water within the hollow interior when said modular flood wall is assembled.

2. The assembly according to claim 1 wherein said blocks further comprise at least one internal support extending from said top surface to said bottom surface.

3. The assembly according to claim 1 further comprising at least one coupling area located on at least one of said side walls, said coupling area allowing said block to be connected to a horizontally adjacent block.

4. The assembly according to claim 1 wherein said blocks comprise a parallelepiped shape.

5. The assembly according to claim 4 wherein said blocks further comprise a coupling area located at least on one opposing pair of side walls, said coupling areas allowing each of said blocks to be connected to a horizontally adjacent block.

6. The assembly according to claim 1, wherein said blocks further comprise at least two protuberances, said protuberances arranged symmetrically on said top surface.

7. The assembly according to claim 6, wherein said blocks further comprise at least two cavities, said cavities arranged symmetrically on said bottom surface.

8. The assembly according to claim 7 wherein said protuberances and said cavities are substantially vertically aligned.

9. The assembly according to claim 1, wherein said blocks comprise a parallelepiped shape, said blocks being symmetrically arranged in both the vertical and horizontal directions.

* * * * *